US006092709A

United States Patent [19]

Schoenbeck et al.

[11] Patent Number: 6,092,709

[45] Date of Patent: Jul. 25, 2000

[54] MACHINE FOR ADVANCING A SHEET METAL STRIP IN MEASURED INCREMENTS

[75] Inventors: Elroy Schoenbeck; Kalin Liefer, both of Randolph County, Ill.

[73] Assignee: Red Bud Industries, Inc., Red Bud, Ill.

[21] Appl. No.: 09/191,300

[22] Filed: Nov. 13, 1998

Related U.S. Application Data

[60] Provisional application No. 60/080,793, Apr. 6, 1998, abandoned.

[51] Int. Cl.[7] ..... B65H 20/24; B65H 23/06; B65H 20/00; F16H 7/14

[52] U.S. Cl. ..... 226/112; 286/150; 286/162; 286/173; 474/114

[58] Field of Search ..... 226/112, 133, 226/136, 141, 150, 151, 162, 173; 474/110, 114

[56] References Cited

U.S. PATENT DOCUMENTS

| | | | |
|---|---|---|---|
| 3,425,611 | 2/1969 | Zelnick | 226/162 |
| 3,613,980 | 10/1971 | Kulig et al. | 226/162 |
| 3,753,522 | 8/1973 | Voges . | |
| 3,777,963 | 12/1973 | Yamamoto | 226/150 X |
| 4,504,004 | 3/1985 | Griesdorn | 226/162 X |
| 4,694,982 | 9/1987 | Plumb | 226/162 X |
| 4,751,838 | 6/1988 | Voges . | |
| 4,887,502 | 12/1989 | Voges . | |
| 5,653,651 | 8/1997 | Kawashima et al. | 474/110 |

*Primary Examiner*—Michael R. Mansen
*Attorney, Agent, or Firm*—Polster, Lieder, Woodruff & Lucchesi, L.L.C.

[57] ABSTRACT

A machine for advancing a strip of sheet metal in measured increments includes a main frame and subframes supported on transverse ways on the main frame so that the subframes may be moved toward and away from each other to vary the spacing between them. The subframes lie along a path that accommodates the sheet metal strip, and at their forward ends have fixed gripping units which clamp down on the strip to prevent it from moving in the path. The subframes have tracks along which movable gripping units move to and fro. The movable gripping units also have the capacity to clamp down on the strip. Each subframe also carries an endless chain which is driven by a hydraulic motor on the subframe to move the movable gripping unit for the subframe along its track. Basically, the movable gripping units alternately grip the strip and advance it, so that while one gripping unit is propelling the strip forwardly, the other is returning to its initial position to thereafter grip the strip and propel it. In the intervals between successive advances, the fixed gripping units clamp down on the strip and the strip is cut at a shear to provide panels of equal length. A hydraulic cylinder exerts a constant force on the chain that drives each movable gripping unit to maintain that chain taut. Each of the fixed and movable gripping units has a pair of pads along which it actually clamps against the metal strip. One pad of the pair lies in a pocket form which it is easily extracted to make room for removal of the other pad.

20 Claims, 6 Drawing Sheets

MACHINE FOR ADVANCING A SHEET METAL STRIP IN MEASURED INCREMENTS

CROSS-REFERENCE TO RELATED APPLICATIONS

This application claims the benefit of U.S. Provisional Application No. 60/080,793, filed Apr. 6, 1998 now abandoned.

STATEMENT REGARDING FEDERALLY SPONSORED RESEARCH OR DEVELOPMENT

Not Applicable.

BACKGROUND OF THE INVENTION

This invention relates in general to a machine for handling sheet metal and more particularly to a machine for feeding or advancing a strip of sheet metal in measured increments.

Sheet metal finds widespread use in manufactured products, particularly in housings for appliances and in cabinets of one sort or another. Most of this sheet metal comes from large coils produced at rolling mills. But usually the width in which the coiled metal sheet is furnished does not correspond to a dimension required for a manufactured product, and never does the length. Typically fabricators slit the sheet longitudinally and shear it transversely to provide panels of a size suitable for further fabrication into manufactured products.

Slitting, when it is performed, presents little difficulty. The knives of the slitter are set in the proper locations, and the metal strip is simply passed through the knives as it is withdrawn from the coil.

On the other hand, shearing presents a greater challenge in that each transverse cut or shear must occur while the sheet metal strip is at rest. This requires advancing the strip a prescribed distance, stopping it, then shearing it, and then repeating the foregoing. Two types of feeding machines have evolved for effecting incremental advances. One relies on pinch rollers through which the sheet metal strip passes. The rollers start and stop, rotating precisely the same amount each time. The rollers, however, grip the metal strip only in very limited areas, and are susceptible to slipping, particularly in the presence of oils which one invariably finds on coiled steel strip. Of course, any slippage detracts from the precision which is so necessary in producing panels of equal size.

The other type of feeding machine has gripping units which grip the strip and move with the strip as the strip advances, and indeed the strip remains gripped at the same locations during the entire incremental advance. The areas along which the strip as gripped are quite large, so slippage is less likely to occur. Thus, this gripper-type of machine advances the strip with considerable precision. However, after each advance the gripping units must return to their original positions to again grip the strip for the next advance. The shear cuts the strip transversely while the strip is at rest, but even so the shearing takes less time than the return of the gripping units, so that machines with movable gripping units do not operate as rapidly as feeding machines with pinch rollers. U.S. Pat. No. 3,753,522 entitled Sheet Transferring Device and Method discloses a gripper-type feeding machine, that is one with movable gripping units.

A gripper-type feeding machine actually grips the sheet metal strip along pads having their surfaces ground smooth to avoid marring the metal sheet where they clamp down on the strip. From time to time these pads must be removed to refinish their ground surfaces. Typically, machine screws secure the pads and of course must be removed to release the pads. This is a time consuming procedure.

In a gripper-type feeding machine, the gripping units are typically advanced and retracted with an endless chain that passes over sprockets at each end of the paths taken by the gripping units. The chains transmit substantial forces during the advance of the strip and in time stretch and become loose.

BRIEF SUMMARY OF THE INVENTION

The present invention resides in a gripper-type feeding machine which grips the metal strip alternately along its sides, so that as one grip holds the strip along one side and advances it, the other grip returns along the other side to thereafter grip the strip for the next advance. This enables the strip to be advanced more rapidly through a shear and indeed affords feeding rates that exceed those of roller-type feeding machines. The invention also resides in a gripping unit for a gripper-type feeding machine, and that unit has a pad which is held in a pocket on a horizontally directed retaining pin. The pin is spring biased toward the pocket, but is easily moved away from the pocket to ,withdraw the pad from the pocket for quick and easy replacement. The gripper units along each side of the machine are coupled to chains which pass over sprockets that are driven by motors. Fluid pressurized cylinders act upon sprockets around which the chains pass to control the tension that exists within the chains so that excessive slack does not develop. The invention also consists in the parts and in the arrangements and combinations of parts hereinafter described and claimed.

BRIEF DESCRIPTION OF THE SEVERAL VIEWS OF THE DRAWINGS

In the accompanying drawings which form part of the specification and wherein like numerals and letters refer to like parts wherever they occur.

Corresponding reference numerals will be used throughout the several figures of the drawings.

DETAILED DESCRIPTION OF THE INVENTION

Figure 1:
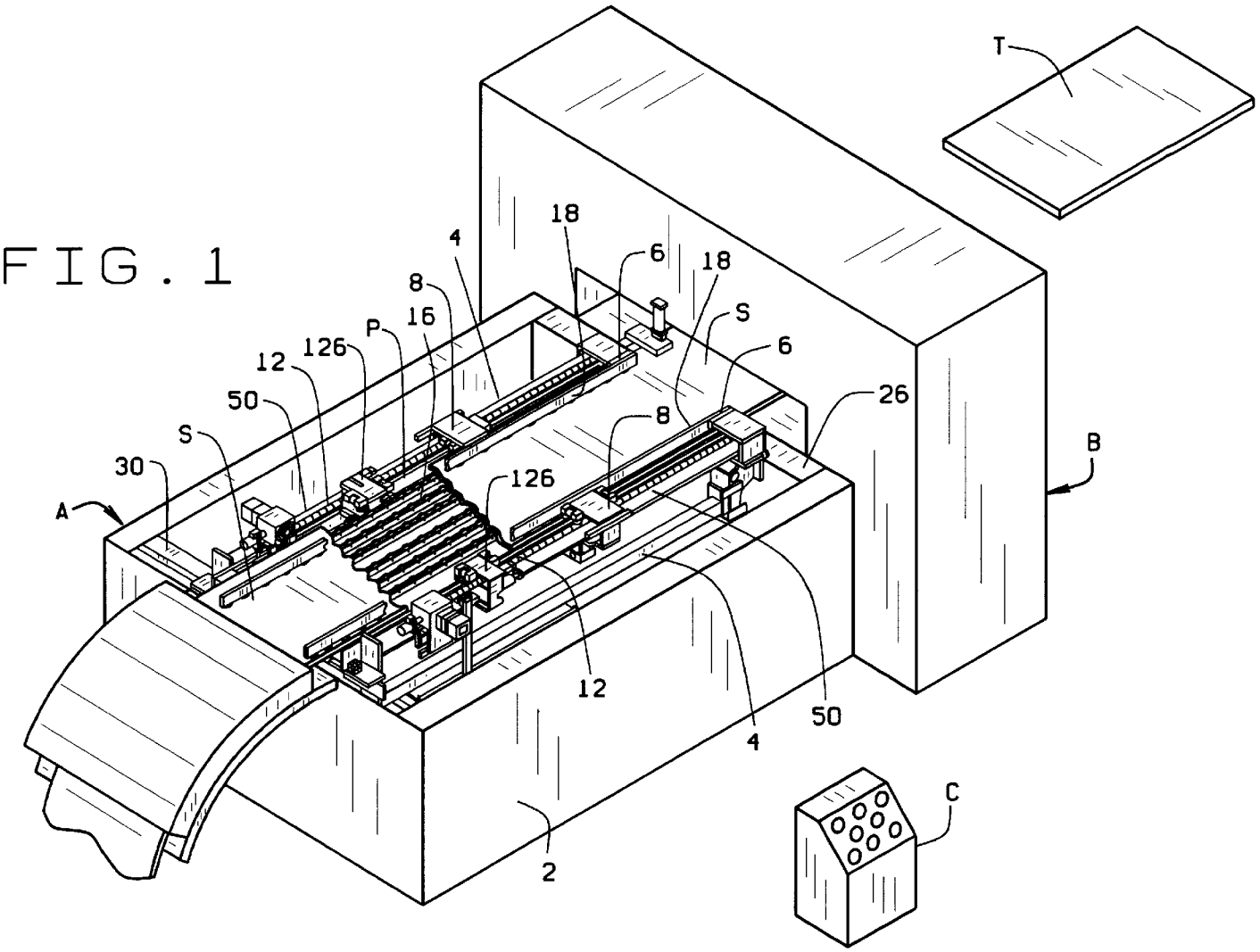
FIG. 1 is a perspective view of a machine construction in accordance with and embodying the present invention for feeding sheet metal strip in measured increments into a shear.

Referring now to the drawings, a machine A (FIG. 1) withdraws a strip S of metal sheet from a coil and advances the strip S in measured increments into a shear B. Between each incremental advance, the shear B severs a panel T from the strip S. The length of the panel T, measured in the direction of the advance through the shear B, equals the length of the advance. Preferably, the strip S between the coil from which it is withdrawn and the machine A has a loop which drops downwardly into a pit in the floor on which the machine A is installed, and that loop eliminates the torsional inertia of the coil from each incremental advance. The strip S may range from 30 gauge steel sheet to much thicker ¼ inch sheet. Each advance imparted to the strip S by the machine A is precisely the same. so the panels T that are cut from the end of the strip are exactly the same size.

Figure 2:
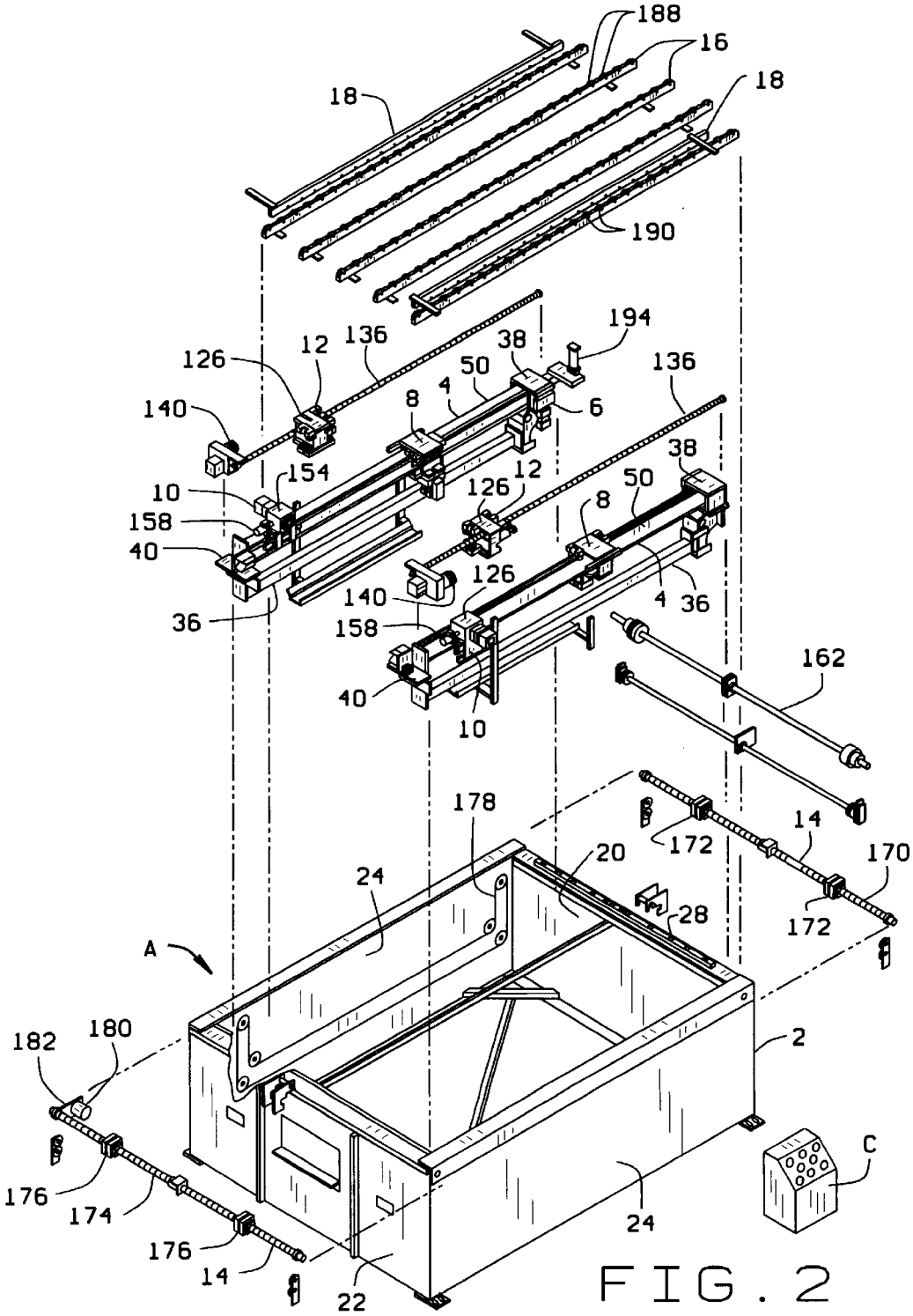
FIG. 2 is an exploded perspective view of the machine.

The machine A includes (FIGS. 1 and 2) a main frame 2 over which the strip S passes, thereby establishing a path P of advance. In addition, the machine A has two subframes 4 which lie along the sides of the path P. The subframes 4 carry fixed gripper units 6 and movable gripper units 8, which also form part of the machine A, as do drive mechanisms 10 which advance and retract the movable gripper units 8 along the sides of the path P. Also, the machine A has a stop mechanisms 12 which establish the length of travel for the movable gripper units 8 and hence the incremental advance of the strip S. Moreover, the machine A includes a positioning mechanism 14 which moves the subframes 4 toward and away from each other to change the width of the path P and thereby accommodate sheet metal strips S of varying width. Finally, the machine A has support members 16 which rest on the frame 2 between the subframes 4 to support the strip S along the path P and hold-down members 18 which are attached to the subframes 4 and keep the strip S from rising out of the path P. The gripper units 6 and 8, drive mechanisms 10, stop mechanisms 12, and positioning mechanism 14 operate under the control of circuitry in a control console C that forms part of the machine A. That circuitry, which contains microprocesses, also controls the operation of the shear B.

Turning first to the main frame 2 (FIG. 2), it is essentially box-shaped, having a front wall 20, a rear wall 22 and side walls 24 connecting the front and rear walls 20 and 22. Each wall 20, 22 and 24 contains members which rigidify it and still more members extend between the walls 20, 22 and 24 to rigidify the frame 2 as a whole. The path P lies along the top of the frame 2, so that the sheet metal strip S passes over the frame 2. The front wall 20 carries a way or track 26 which has upwardly and downwardly presented surfaces and a rib 28 directed upwardly from the former to provide vertical surfaces that are presented both forwardly and rearwardly. The rear wall 22 carries a way or track 30 that has upwardly and downwardly presented surfaces. Both tracks 26 and 30 extend transversely with respect to the path P, passing beneath the path P.

Each subframe 4 includes (FIGS. 2 and 7) a longitudinal member 36 which extends practically the full length of the subframe 4 and a front bracket 38 attached to the front end of the member 36 and a rear bracket 40 attached to the rear end. The front bracket 38 has a set of horizontal rollers 42 which contact the horizontal surfaces of the front track 26. The rollers 42 that contact the upwardly presented surface support the subframe 4 on the front track 26, whereas the horizontal rollers 42 that lie along the downwardly presented surface prevent the front of the subframe 4 from lifting off the track 26,. The front bracket 38 also has vertical rollers 44 which lie along both vertical surfaces on the rib 28 that forms part of the front track 26. The horizontal rollers 42 capture the bracket 38 and the front of the subframe 4—vertically on the track 26. The vertical rollers 44 capture the bracket 38 and subframe 4 longitudinally. Neither the horizontal rollers 42 nor the vertical rollers 44 capture the front bracket transversely, so the bracket 38 may move along the front track 26.

Figure 3:
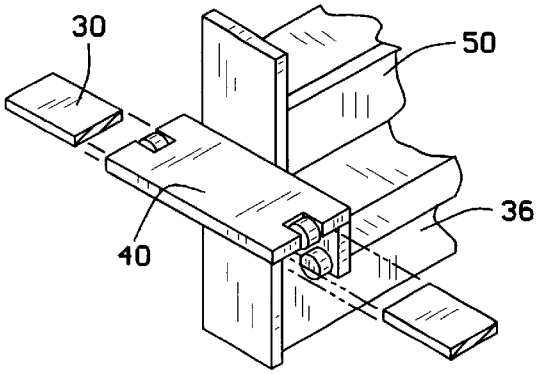
FIG. 3 is a fragmentary view showing the rear bracket on one of the subframes for the machine.

The rear bracket 40 has horizontal rollers 46 (FIG. 3) which lie along the upwardly and downwardly presented surfaces of rear track 30. As such, the rollers 46 support the rear bracket 40 and the rear of the subframe 4 on the rear track 30 and likewise prevent t em from lifting off the track 38. But they do not restrict movement of the bracket 40 along the track Thus, by reason of the placement of the rollers 42 and 44 on the front bracket 38 and the rollers 46 on the rear bracket 40, the subframes 4 are confined vertically and longitudinally, but not transversely. They may move, without interference from the rollers 42, 44 and 46, along the tracks 26 and 28, that is they move transversely with respect to the path P.

In addition to its longitudinal member 36 and brackets 38 and 40, each subframe 4 has a T-shaped track 50 (FIGS. 3 and 4) which extends essentially the full length of the subframe 4, being secured at its ends to the brackets 38 and 40. In contrast to the tracks 26 and 30 on the main frame 2, the tracks 50 on the subframes 4 lie parallel to the path P immediately beyond the sides of the path P. Each track 50 has vertical rails 52 and a horizontal rigidifying member 54, the former being presented toward the path P and the latter toward one of the side walls 24 of the main frame 2. The horizontal member 54 is attached with machine screws to the vertical rail 52 midway between the upper and lower edges of the vertical rail 52.

Each subframe 4 is equipped with a dashpot 56 (FIG. 7) which is attached to its front bracket 38 below the horizontal rail 54 of the track. The dashpot 56 has a plunger which is presented toward the rear bracket 40 and is adapted to retract in the presence of a force oriented parallel to the track 50.

Figure 4:
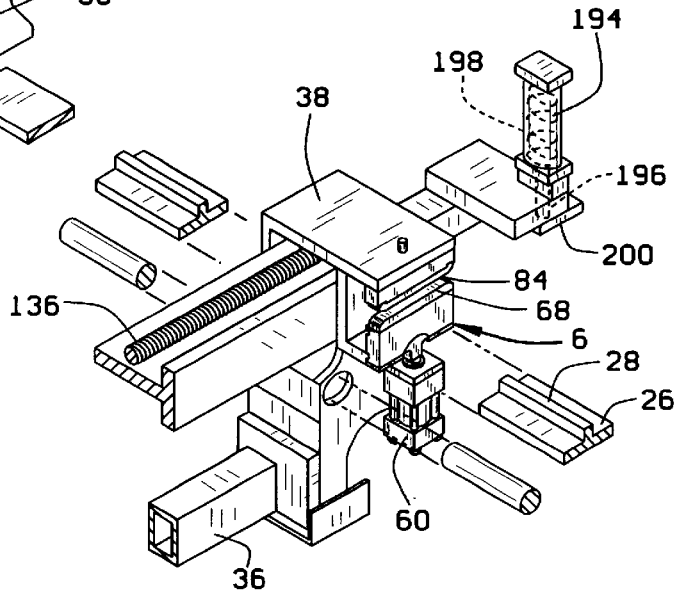
FIG. 4 is a fragmentary view showing the front bracket on one of the subframes for the machine.

The fixed gripper units 6 are mounted solidly on the front brackets 38 of the subframes 4 (FIG. 4). Each is attached to the inside face of its bracket 38 such that it projects over the side of the path P along which it is located. Indeed, the strip S at its sides extends through the two gripper units 6, which in unison either clamp down on the strip S and secure it in the path P or else release the strip S so that it may advance along the path P.

Figure 5:
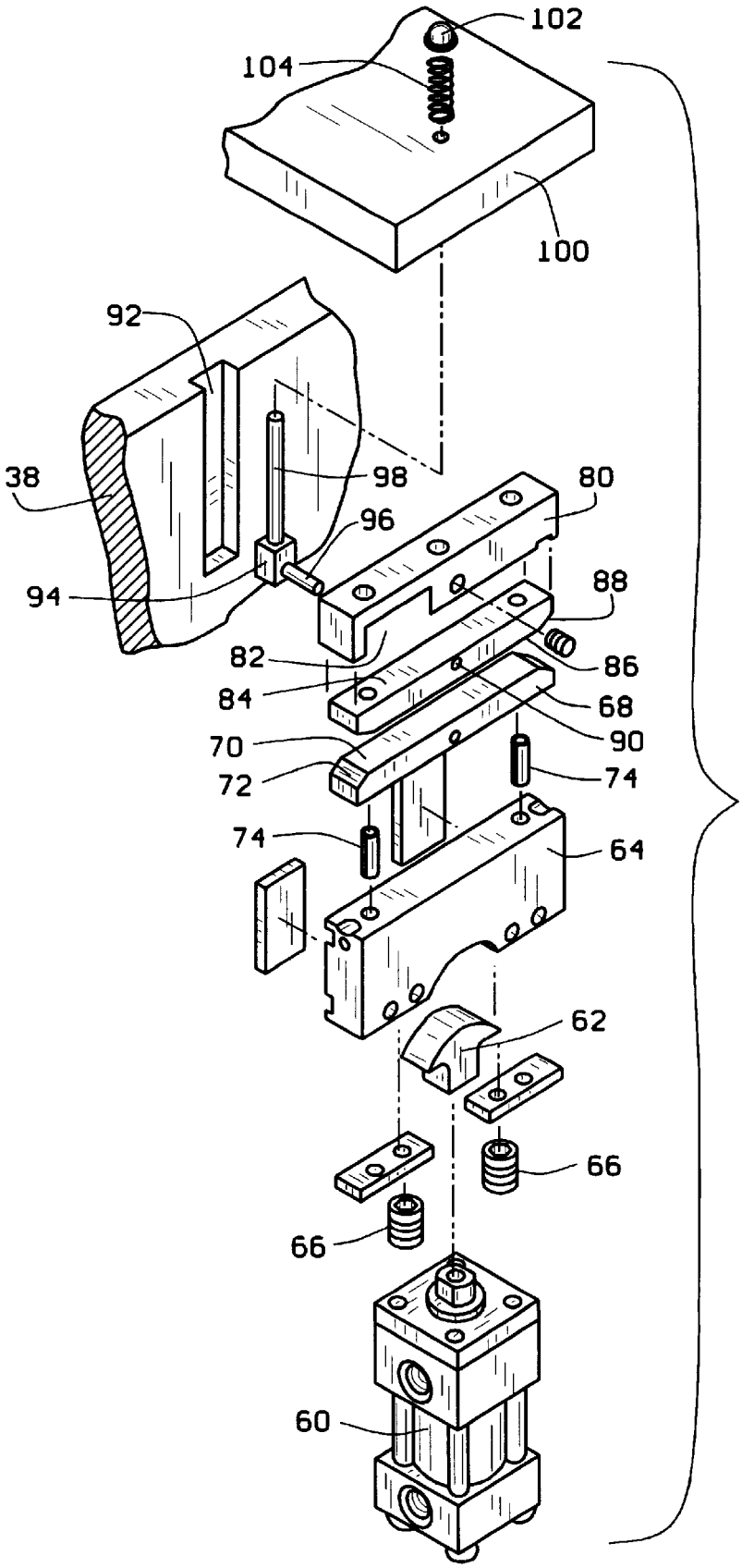
FIG. 5 is an exploded respective view of one of the gripping units of the machine.

Each fixed gripper unit 6 includes (FIG. 5) an actuating cylinder 60 which is secured firmly to the front bracket 38 with its axis extended vertically and its piston rod projecting upwardly. The piston rod has a head 62 provided with a convex upper surface which bears against a lower retaining block 64 that is free to move upwardly and downwardly and to rock slightly, but is otherwise confined. To accommodate rocking, the block 64 along its bottom has a concave surface which conforms to the convex surface on the head 62. Between the bottom of the block 64 and the top of cylinder 60 lie springs 66—one on each side of the rod for the cylinder 60—and those spring 66 stabilize the block 64, that is they prevent it from rocking unless it is subjected to a force strong enough to overcome the forces exerted by the springs 60. The block 64 supports a gripping pad 68 having a smooth gripping surface 70 which is presented upwardly, and beveled corners 72 at the ends of the gripping surface 70. The pad 68 has two pins 74 fitted to it, and those pins 74 project downwardly from its underside into holes in the block 64. The pins 74 engage the pad 68 with the underlying block 64 so that it cannot be displaced horizontally from the block 64, but the fit between the pins 74 and the holes in the block 64 is such that one can easily lift the pad 70 off the block 64.

In addition, the fixed gripper unit 6 has an upper retaining block 80 (FIG. 5) which is located over the path P directly above the lower retaining block 64, and, like the cylinder 60, it is secured firmly to the front bracket 38. The upper block 80 contains a pocket 82 which opens downwardly toward and aligns with the pad 68 on the lower block 64. The pocket 82 contains an upper gripping pad 84 which fits snugly in it, but not so tightly that it cannot be displaced downwardly out of the pocket 82 simply by manual effort. The upper pad 84 has a gripping surface 86 that is presented downwardly and beveled corners 88 at the ends of the gripping surface 86. Midway between its ends the pad 84 has a transversely directed hole 90 that lies parallel to the gripping surface 86.

The front bracket 38, immediately behind the upper retaining block 80 for the griping unit 6, contains a vertical groove 92 (FIG. 5) which holds a slide 94 that is free to move upwardly and downwardly in the groove 92. The slide 94 carries a retaining pin 96 which projects laterally from it into the transverse hole 90 in the gripping pad 84. The slide 94 moves within the groove 92 between an extended position, wherein the retaining pin 96 lies below the block 80, and a retracted position, wherein the pin 96 lies closer to the block 80. The slide 94 also carries an actuating pin 98 which projects upwardly from it and passes loosely through an overhanging portion 100 of the upper bracket 38. At its upper end the actuating pin 98 has a head 102, and between the head 102 and the overhanging portion 100 of the bracket 38 a coil-type compression spring 104 encircles the pin 98 and urges it upwardly. The spring 104 biases the slide 94 to its retracted position in which the retaining pin 96 is immediately below the pocket 82 in the upper block 80. When so disposed, the pin 96 holds the upper pad 84 in the pocket 82. Thus, the slide 94 and its two pins 96 and 98, as well as the spring 104, constitute a retainer for the upper pad 84.

When the piston of the cylinder 60 is in its retraced position, enough space exists between the lower pad 68 and the upper retaining block 80 to accommodate the upper gripping pad 84. Also, when the piston rod of the cylinder 60 is retracted and the upper pad 84 is removed from the upper retaining block 80, enough space exists between the upper retaining block 80 and lower retaining block 64 to accommodate the lower pad 68 including its retaining pins 74. Finally, when both gripping pads 70 and 84 are in place on their respective blocks 64 and 80 and the piston of the cylinder 60 is retracted, enough space exists between the opposed gripping surfaces 70 and 86 of the pads 68 and 84 to accommodate the strip S—indeed, with enough clearance to enable the strip S to slide easily between the pads 68 and 84. However, when the cylinder 60 is energized, its piston elevates the lower block 64, driving the lower pad toward the fixed upper pad 84. The pads 68 and 84, and their gripping surfaces 70 and 86, bear against the strip S of sheet metal and clamp it snugly in place so that it cannot move along the path P. Since the lower pad 68 has the capacity to rock, the two pads 68 and 84 seat firmly against the strip S. This produces a uniform clamping pressure along the gripping surfaces 70 and 86 and compensates for imperfections in the strip S. When the strip 5 is carbon steel, hardened steel pads functions quite well for the pads 68 and 84 in that it grips the strip 5 firmly without marring it. An alternative gripper pad utilizes a micarta material where as the steel gripper pad has a machined pocket that retains the micarta. The micarta is used to avoid marking of very surface sensitive material. From time-to-time the micarta insert is placed after it has worn.

To remove the pads 68 and 84 from the fixed gripper unit 6, the operator first depresses the actuating pin 98 against the bias of its spring 104. This drops the upper pad 84 out of the pocket 82 in the upper block 80. Once the pad 84 is free of the pocket 82, the operator slides it off of its retaining pin 96. The operator then releases the actuating pin 98 and the retaining pin 96 retracts toward the pocket 82. Next the operator lifts the lower pad 68 away from the lower retaining block 64. When the pins 74 on the lower pad 68 clear the block 64, the operator withdraws the pad 68 from the space between the two blocks 64 and 80. The pads 68 and 84 are installed on the blocks 64 and 80 in the reverse of the sequence.

The movable gripper unit 8 for each subframe 4 actually travels along the track 50 for that subframe, and to this end includes a carriage 110 (FIG. 6) which follows, yet is confined laterally and vertically by the rail 52 for the track 50. Otherwise the movable gripper unit 8 is the same as the fixed gripper unit 6, it likewise having a cylinder 60, retaining block 64, lower pad 68, upper retaining block 80 and upper pad 84. The cylinder 60 and upper retaining block 80, instead of being secured firmly to the front bracket 38 for the subframe 4, are secured firmly to the carriage 110 which follows the track 50 on the subframe 4.

Figure 6:
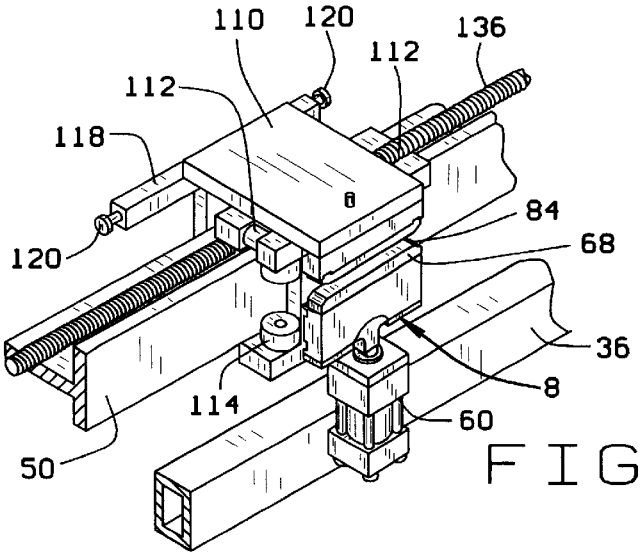
FIG. 6 is a perspective view of one of the movable gripping units and its carriage.
Figure 7:
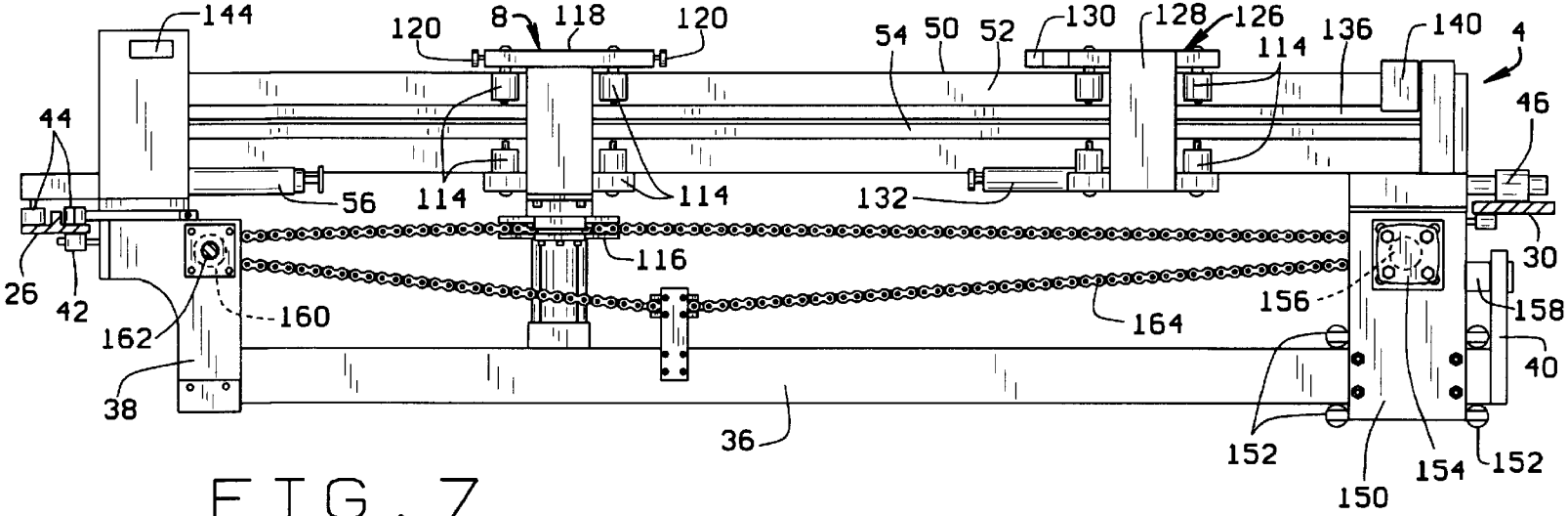
FIG. 7 is a side elevational view of one of the subframes.

The carriage 110 extends completely around the track 50 and as such lies along the vertical rail 52 of the track 50 and also over the horizontal member 54 (FIGS. 6 and 7). It has two horizontal rollers 112 which roll along the upper edge of the vertical rail 52 and two more horizontal rollers 112 that roll along the lower edge of the vertical rail 52. The horizontal rollers 112 prevent the carriage 110 from being displaced vertically or rocking about a horizontal axes. In addition, the carriage 110 has two sets of vertical rollers 114 arranged in pairs above the horizontal member 54 and another two sets of vertical rollers 114 arranged in two pairs below horizontal member 54. Within each pair of vertical rollers 114, one rolls along the inside surface of the vertical rail 52 and the other rolls along the outside surface. The vertical rollers 114 prevent the carriage 110 from being displaced laterally and from twisting about longitudinal and vertical axes. Yet the carriage 110 is free to move longitudinally to and from along the track 50. Directly below the horizontal member 54 of the track 50, the carriage 110 is fitted with a chain clamp 116. The carriage 110 also carries a stop bar 118 which lies parallel to the track 50 and has adjustable actuators 120 at its end.

Figure 8:
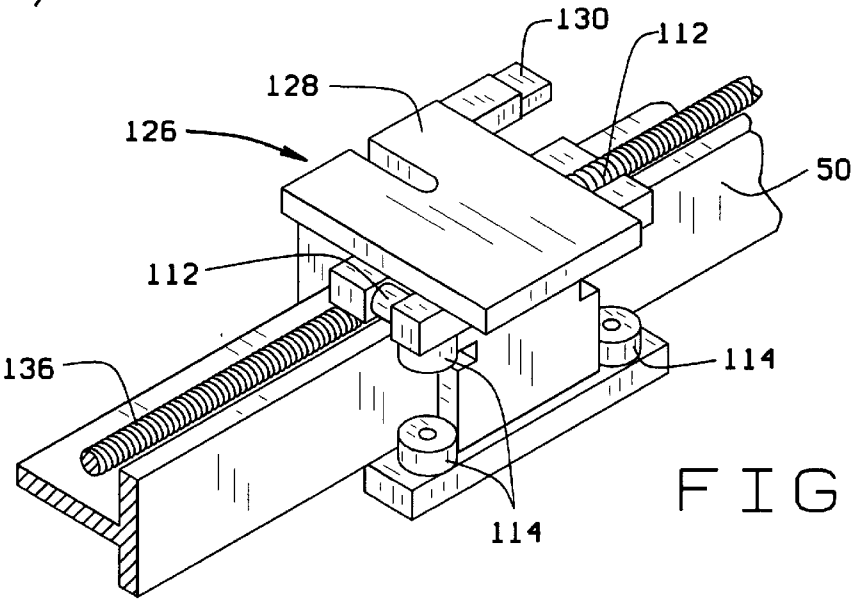
FIG. 8 is a perspective view of one of the backstops.

The stop mechanisms 12 limit the return of the movable gripper units 8 along the tracks 50, and thus establish the length of travel or strokes for the movable gripper units 8. That, of course, equals the distance of each incremental advance of the sheet metal strip S. Each stop mechanism 12 includes a backstop 126 (FIGS. 7 and 8) that lies along one of the tracks 50, and the backstop 126 has a carriage 128 which is essentially the same as the carriage 110 for the corresponding movable gripper unit 8. As such it has horizontal rollers 112 and vertical rollers 114 which roll along the vertical rail 52 of the track 50, yet confine the carriage 128 both vertically and laterally. The carriage 128 for the backstop 126, however, is fitted with a sensor 130 which aligns with the stop bar 118 on the corresponding movable gripper unit 8 to detect the approach of the actuator 120 on the rear end of the stop bar 118. In addition, the carriage 128 for the backstop 126 is fitted with a dashpot 132 having a plunger which is presented toward the movable gripper unit 8 and is engaged by the carriage 110 of the gripper unit 8 as the actuator 120 on its stop bar 118 approaches the sensor 130.

The stop mechanism 12 for each subframe 4 also includes a lead screw 136 (FIGS. 2 and 7) that extends over the horizontal member 54 of the T-shaped track 50 and rotates in bearings fitted to the front and rear brackets 38 and 40 of the subframe 4. The lead screw 136 engages a nut (not shown) on the carriage 128 of the backstop 126. Thus, when the screw 136 rotates, the backstop 126 moves along the track 50, the direction being dependent on the direction of rotation for the screw 136. The rotation is provided by a hydraulic motor 140 which is mounted on the rear bracket 40 of the subframe 4 and is coupled with the rear end of the lead screw 136.

Finally, the stop mechanism 12 on each subframe 4 includes a sensor 144 (FIG. 3) that is mounted on the front bracket 38 of the subframe 4 in alignment with the stop bar 118 for the gripper unit 8 on that subframe 4. As the carriage 110 of the movable gripper 8 comes against the dashpot 56 on the front bracket 38, the front actuator 120 on the stop bar 118 approaches the sensor 144, causing the sensor 144 to produce a signal.

Each subframe 4 has its own drive mechanism 10 (FIG. 7), and that drive mechanism 10 moves the movable gripper unit 8 for the subframe 4 to and fro between the backstop 126 and the front bracket 38, which likewise serves as a stop along the subframe 4. To this end, the drive mechanism 10 on each subframe 4 includes a carriage 150 which rests on the longitudinal member 36 of subframe 4 near the rear bracket 40 for that subframe 4. Indeed, the carriage 150 has horizontal rollers 152 which support it on the upper surface of the member 36. The carriage 150 in turn supports a hydraulic motor 154 which turns a sprocket 156 that is located beneath the horizontal member 54 of the track 50 for the subframe 4. Even though the carriage 150 has the rollers 152, it has only a very limited range of movement along the longitudinal member 36 in that it is coupled to the rear bracket 40 for the subframe 4 though a short hydraulic cylinder 158, so the range of movement is in essence the length of the stroke for the cylinder 158.

At the other end of each subframe 4, the drive mechanism 10 includes an idler sprocket 160 (FIG. 7) located in each front bracket 38 likewise at an elevation below the horizontal member 54 of the T-shaped track 50. Actually, the idler sprockets 160 in the two front brackets 38 are mounted on a cross shaft 162 which extends through the brackets 38 and is confined at its ends in bearings that are mounted on the side walls 24 of the main frame 2 and at its middle by more bearings that are supported on the front wall 20 of the main frame 2. Thus, the cross shaft 162 is split, so its two sections may rotate independently and the idler sprockets 160 likewise with them while the idler sprockets 160 are not powered, they are nevertheless coupled to the cross shaft 162 at baplines so that the portion of the cross shaft 162 on which each sprocket 160 is mounted rotates with the sprocket 160, yet the sprocket 160 can move along the shaft 162 to accommodate displacement of the subframes 4 along the transverse tracks 26 and 30.

Lastly, the drive mechanism 10 on each subframe 4 further includes a chain 164 (FIG. 7) which passes a round the sprocket 156 on the hydraulic motor 154 for that subframe 4 and also over the idler sprocket 160 in the front bracket 38 for that subframe 4. The ends of the chain 164 come together beneath the carriage 110 for the gripper unit 8 on the subframe 4 and are secured in the chain clamp 116 for the carriage 110, in effect making the chain 164 continuous or endless. The hydraulic cylinder 158, when energized, urges the carriage 150 for the hydraulic motor 154 toward the rear bracket 40 and draws the chain 164 taut, and indeed, the tension within the chain 164 is controlled by the cylinder 158.

When the hydraulic 154 motor on either subframe 4 is energized in one direction of rotation the chain 164 for that subframe 4 moves over the sprockets 156 and 160 and propels the carriage 150 along the track 50 for the subframe 4. The direction in which the carriage 150 moves, of course, depends on the direction of rotation imparted to the sprocket 156 by the motor 154.

The positioning mechanism 14 (FIG. 2) moves the subframes 4 toward and away from each other so as to set the spacing between the fixed gripper units 6 and the two movable gripper units 8. This controls the width of the path P and enables the machine A to accommodate sheet metal strips S of varying widths. The positioning mechanism 14 includes a front lead screw 170 which rotates in bearings attached to the side walls 24 of the frame 2 slightly below the front track 26. The lead screw 170 engages nuts 172 that are attached to the front brackets 38 of the subframes 4. The direction of the thread changes midway between the ends of the lead screw 170. Thus, when the lead screw 170 rotates in one direction, the front brackets 40 and the two subframes 4 move apart and when it rotates in the opposite direction the front brackets move together.

Likewise, along the rear wall 22 of the main frame 2, the positioning mechanism 14 has a rear lead screw 174 which rotates in bearings located on the side walls 24 of the main frame 2 slightly below the rear track 30. The lead screw 174 passes through and engages nuts 176 on the rear brackets 40 of the two subframes 4. The lead screw 174 also has threads of differing direction. Thus, when it rotates, the rear brackets 40 move together or apart—depending on the direction of rotation. Moreover, the pitch on the threads of the rear lead screw 174 equal the pitch of the threads on the front lead screw 170.

The two lead screws 170 and 174 rotate in unison, this being effected by chain-and-sprocket links 178 which connect the two lead screws 170 and 174 along the side walls 24 of the main frame 2. The rotation is derived from a hydraulic motor 180 which is mounted on one of the side walls 24 and is coupled with the rear screw 174 though a sprocket-and-chain drive 182.

The support members 16 rest on the front and rear tracks 26 and 30 and have rollers 188 (FIGS. 1 and 2) which are presented upwardly such that their peripheries form a planar supporting surface that lies just below the plane in which the gripping surfaces 86 for the upper pads 84 or the gripper units 6 and 8 lie. Thus, the rollers 188 form the bottom of the path P along which the strip S of sheet metal moves.

The holddown members 18 lie over the path P immediately inwardly from the gripper units 6 and 8 and have rollers 190 (FIG. 2) which are presented downwardly. The peripheries of the rollers 190 lie in the same plane as the gripping surfaces 86 on the upper pads 84 for the gripping units 6 and 8. At their ends the holddown members 18 are attached to the front and rear brackets 38 and 40 of the subframes 4.

The front bracket 38 of one of the subframes 4 carries a holddown cylinder 194 (FIG. 4) which contains a piston rod 196 and also a heavy compression spring 198 which urges the rod 196 out of the rod end of the cylinder 194. The rod 196 is fitted with a shoe 200. When the spring 200 alone acts on the piston in the cylinder 194, it drives the shoe 198 with enough force against the strip S in the path to prevent the strip S from moving along the path P, even when none of the gripping units 6 or 8 clamps the strip S. In this regard, it will be recalled that the strip S between the coil on which it is supplied and the machine A loops downwardly into a pit to better accommodate the incremental advances that the strip S undergoes. The weight of the segment of the strip S that forms the loop is enough to pull the forward segment of the strip S out of the machine A, unless that segment is secured. The cylinder 194 provides this securement however, when the machine A is in operation, hydraulic fluid is directed into the rod end of the cylinder 194 with enough pressure to elevate the shoe 200 so it does not impede movement of the strip S along the path P.

To prepare the machine A for operation, the operator from the control console C adjusts the width of the path P to accommodate the sheet metal strip S scheduled to pass through the machine A. In this regard, the subframes 4 should be set close enough together to enable the sides of the strip S to pass between the lower and upper gripping pads 68 and 84 on all of the gripper units 6 and 8, yet far enough apart that the strip S does not otherwise interfere with the gripping units 6 and 8. To this end, the operator from the control console energizes the hydraulic motor 180, which being coupled to the rear lead screw 174 through the chain and sprocket links 178, turns that lead screw 174 in the direction required to further separate the subframes 4 or bring them together, whatever is desired. Since the front lead screw 170 is connected to the rear lead screw 174 through the sprocket-and-chain drive 178, the front lead screw 170 likewise rotates to move the subframes 4 in the same direction that the rear lead screw 174 moves them. Being on horizontal rollers 42 and 46 at their front and rear brackets 38 and 40, respectively, the subframes 4 move together or apart with little resistance. The vertical rollers 44 on the front brackets 38 roll along the rib 28 on the front track 26 and prevent the subframes 4 from displacing longitudinally in the main frame 2. Thus, irrespective of their positions along the front and rear tracks 26 and 30, the subframes 4 remain in the same distance from the front and rear walls 20 and 22 of the main frame 2 and from the shear B.

After the spacing between the two side frames 4 is adjusted, the support members 16 are spread generally uniformly apart in the region between the two subframes 4. The rollers 188 on the support members 16 form a generally uniform supporting surface along the bottom of the path P.

Also, the operator sets the stroke of the machine A to correspond with the length of panels T scheduled to be sheared from the strip S at the shear B. The stroke, of course, represents the distance the rear gripping units 8 travel as they move between the backstop 126 and front bracket 38, which likewise serves as a stop, and that distance depends on the location of the backstops 126 along the T-shaped tracks 50 for the subframes 4. To set the backstops 126 the operator, again from the console C, energizes the hydraulic motors 140, which rotate the lead screws 136, which in turn move the rear gripping units 8 toward the front brackets 38, thereby shortening the stroke, or toward the rear brackets 40, thereby lengthening the stroke, depending on the direction of rotation imparted to the lead screws 136.

Typically, the two backstops 126 are set to provide their respective gripping units 8 with the same stroke. However, each lead screw 136 and the gripping unit 8 coupled to it is controlled by a different hydraulic motor 140, so the strokes for the two gripping units 8 may be different. This is acceptable so long as the movable gripping units 8 do not operate in unison.

Once the width of the path P is established and the stroke for the movable gripping units 8 is set, the operator withdraws sheet metal strip S from a coil of the strip and threads it into the path P -indeed far enough to pass between the separated upper and lower gripping pads 68 and 84 on both the movable gripping units 8 and also on the fixed gripping units 6 located further downstream. Thereupon the hydraulic cylinders 60 for the fixed gripping units 6 are energized, and those cylinders 60 drive the lower pads 68 for the fixed gripping units 6 upwardly toward the upper pads 84. Since the strip S along its sides is between the pads 68 and 84 of the fixed gripping units 6, the pads 68 and 64 in each fixed gripping unit 6 clamp tightly down on the strip S and secure it along the path P.

Figure 9A:
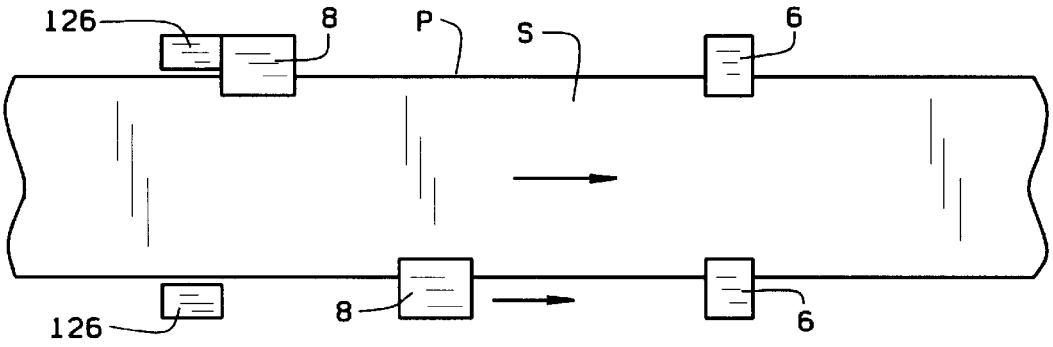
FIGS. 9*a* through 9*d* are schematic view showing the sequence in which the gripping units of the machine operate.

Next, with one of the gripping units 8 in its fully withdrawn position, that is against its backstop 126, the control unit C energizes the hydraulic cylinder 60 for that gripping unit 8. The pads 68 and 84 of that gripping unit 8 likewise clamp down on the sheet metal strip S, further securing the strip S along the path P. With the strip S gripped by the one movable gripping unit 8, the control unit C removes the pressure from the cylinders 60 of the fixed gripping units 6 and the pads 68 and 84 of the fixed unit 6 relax their grip on the strip S. Thereupon the control unit C energizes the hydraulic motor 154 on the subframe 4 where the metal strip S is clamped. The motor 154 draws the chain 164 over the motor sprocket 156 and the idler sprocket 160, and the chain 164 drives the carriage 110 for the clamped gripping unit 8 forwardly along the vertical rail 52 of the track 50 (FIG. 9*a*). The metal strip S, being securely clamped between the pads 68 and 84 of that gripping unit 8, moves forwardly as well. In so doing it moves easily over the rollers 188 of the support members 16 and slides between the open pads 68 and 84 of the fixed gripping units 6. The rollers 190 of the holddown unit keep the strip S from rising away from the rollers 188 of the support members 16.

As the carriage 110 of the advancing gripping unit 8 approaches the front bracket 38 for its subframe 4, the sensor 144 on the bracket 38 detects the presence of the forwardly presented actuator 120 on the stop bar 118 for the carriage 110 and sends a signal to the control unit C which reduces the flow of hydraulic fluid to the motor 154. As a consequence, the carriage 110 decelerates. At about this time the carriage 110 encounters the dashpot 56 on the front bracket 38 and the dashpot 56 effects a further deceleration. The carriage 110 comes to rest with the actuator 120 on its stop bar 118 against the sensor 144 on the front bracket 38.

Figure 9B:
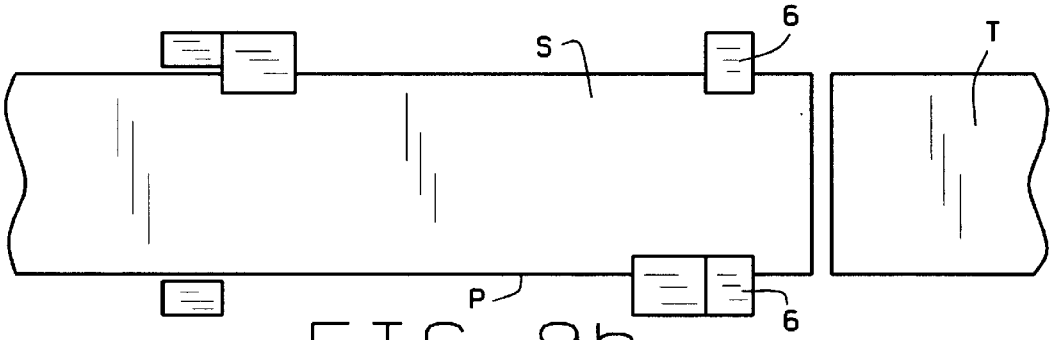

At this juncture, the control unit C energizes the hydraulic cylinders 60 for the two fixed gripping units 6, and the pads 68 and 84 of those gripping units clamp down firmly on the strip S and hold it firmly in place along the path P. With the strip S secured, the control unit C sends a signal to the shear B which shears a panel T from the end of the strip S (FIG. 9*b*).

Figure 9C:
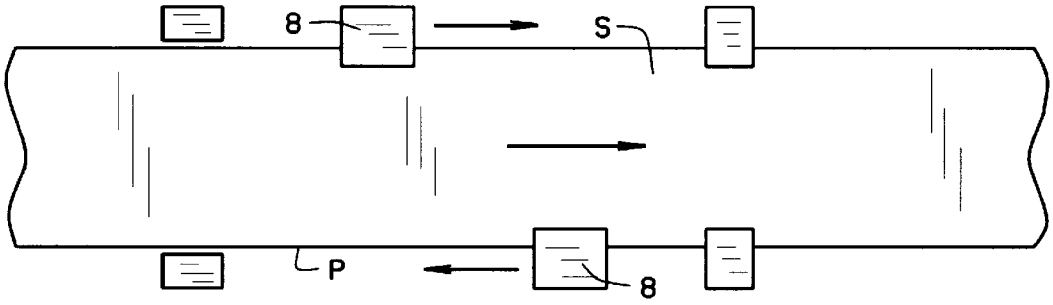

At the same time, the control unit C releases the hydraulic pressure on the cylinder 60 for the advanced movable gripping unit 8, and the pads 68 and 84 for that unit 8 separate and no longer clamp down on the strip S. Thereupon, the control unit C again energizes the hydraulic motor 154 that just advanced the movable gripping unit 8 that is at the front of its track 50, but this time in the opposite direction so that the chain 164 moves the carriage 110 of the movable griping unit 8 in the opposite direction (FIG. 9*c*). The carriage 110 moves along the track 50 away from the front bracket 38 and toward the backstop 126.

The shear B completes its cut while the withdrawing gripping unit 8 moves away from the front bracket 38 and well before it reaches the backstop 126 on its subframe 4. At this time the other gripping unit 8 is in its retracted or withdrawn position against the backstop 126 along its track

50. The control unit C directs pressurized hydraulic fluid to the cylinder 60 of that other movable gripping unit 8, and its pads 68 and 84 close to grip the strip S tightly between them on the other side of the strip S. Immediately afterwards, the control unit C releases the pressure to the cylinders 60 of the fixed units 6, and the pads 68 and 84 of those units 6 relax their grip on the strip S. Thereupon, the control unit C directs hydraulic fluid to the motor 154 o n the other subframe 4, moving the chain 164 on that subframe 4 over its sprockets 156 and 160 and advancing the carriage 110 for the other movable gripper 8 away from its backstop 126 and toward the front bracket 38 on that subframe 4 (FIG. 9*c*). As the carriage 110 approaches the front bracket 38 for subframe 4 over which it moves, its presence is detected by the sensor 144 which directs a signal to the motor 154, causing it to decelerate the chain 164 and the carriage 110. The carriage 110 also encounters the dashpot 56 which further decelerates it. In any event, the carriage 110 comes to rest with the actuator 120 on its stop bar 118 against the sensor 144.

When this occurs, the sensor 144 sends a signal to the control unit, and the control unit energizes the cylinders 60 of the fixed gripping units 6. The pads 68 and 84 of the fixed units 6 clamp down on the strip S and secure it in the path P.

In the meantime, the carriage 110 for the returning gripping unit 8 approaches the sensor 130 on the backstop 126 for the track 50 over which that unit moves, and the sensor 130 sends a signal to the motor 154 for the unit, causing the motor 154 to decelerate. The carriage 110 also encounters the dashpot 132 which assists in the deceleration. When the actuator 120 on the stop bar 118 for the returning carriage 110 reaches the sensor 130, the carriage comes to rest (FIG. 9*d*).

Figure 9D:
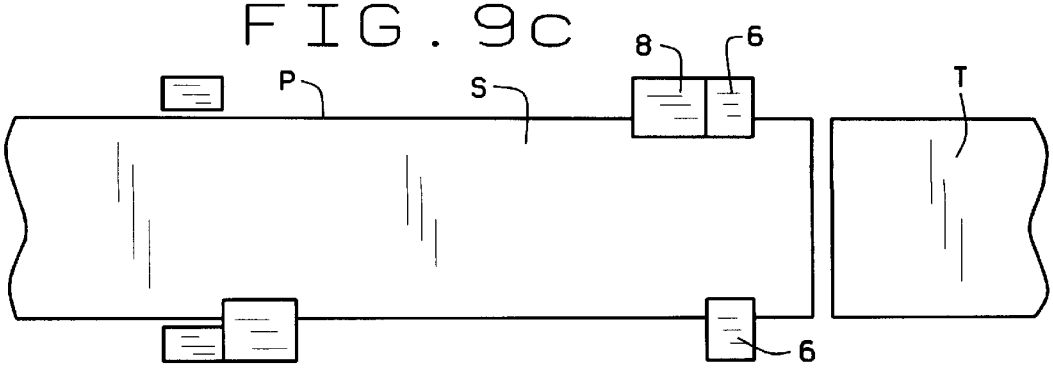

With the strip S now held firmly by the fixed clamping units 6, the control unit C again activates the shear B which cuts another panel T from the strip S (FIG. 9*d*). The longitudinal dimension of the panel T cut corresponds to the distance that the movable gripping unit 8 which last engaged the strip S moved the strip S along the path P, and that of course equals the stroke of that movable gripping unit 8.

The foregoing sequence repeats itself with the movable gripping units 8 alternately gripping the strip S with their pads 68 and 84 and advancing it. Assuming that the backstops 126 on the two subframes 4 are set to provide the same stroke, the panels T cut by the shear B will have the same length. In the alternative, the backstops 126 may be set to provide strokes of different length, in which case alternate panels T cut from the strip S will have the same length.

On the other hand, the machine A may be configured to operate similar to a conventional gripper-type machine, that is with its gripping units 8 advancing and retracting over their respective tracks in unison. This is achieved by making the cross shaft 162 continuous instead of split and reprogramming the control C to accommodate the movement of the gripping units 8 in unison.

This invention is intended to cover all changes and modifications of the example of the invention herein chosen for purposes of the disclosure which do not constitute departures from the spirit and scope of the invention

What is claimed is:

1. A machine for advancing a sheet metal strip in increments, said machine comprising: a frame along which a path extends for accommodating the sheet metal strip; a fixed gripping unit supported on the frame for clamping the strip and preventing it from moving along the path; first and second tracks supported on the frame and located parallel to the path; first and second movable gripping units mounted on the first and second tracks, respectively, for movement along those tracks, each gripping unit being capable of clamping the strip; first and second drive mechanisms coupled to the first and second movable gripping units, respectively, for advancing the gripping units along the path and retracting them along the path, each drive mechanism including a chain connected to the gripping unit for that drive mechanism, a drive sprocket engaged with the chain, and a motor for rotating the drive sprocket and thereby moving the chain such that the gripping unit to which the chain is connected will advance and retract along the path, the motors of the first and second drive mechanisms being operable independently of each other, enabling the first and second gripping units to move independently of each other along the path, so that when one clamps the strip and advances, thereby advancing the strip, the other may retract along the path.

2. A machine according to claim 1 wherein for each drive mechanism the drive sprocket for that drive mechanism is located at one end of the track for the movable gripping unit moved by that drive mechanism; wherein the chain of that drive mechanism passes over an idler sprocket at the other end of the track, and wherein a fluid-operated cylinder urges one of the sprockets away from the other sprocket to maintain the chain taut.

3. A machine according to claim 2 wherein the fluid-operated cylinder urges the motor and sprocket which it drives away from the idler sprocket.

4. A machine according to claim 1 wherein the frame has ways which extend transversely with respect to the path at its front and rear; wherein the tracks are on subframes which are supported on the ways and are capable of moving along the ways to vary the width of the path.

5. A machine according to claim 4 wherein each subframe includes a front bracket that rests on and is capable of moving along the transverse way at the front of the frame; and wherein the fixed gripping unit is one of two fixed gripping units, and the fixed gripping units are mounted on the front brackets of the subframes.

6. In a machine for advancing a strip of sheet metal in increments along a path; a gripping unit for gripping and releasing the strip along one of the sides of the strip, said gripping unit comprising: a first block; a first pad releasably attached to the first block and having a gripping surface located along the path such that it is presented toward one face of strip that is along the path; a second block containing a pocket that opens toward the first pad; a second pad in the pocket of the second block and having a gripping surface which is presented toward the gripping surface of the first pad, whereby it will be presented toward the opposite face of the strip, the second pad having a hole that lies generally parallel to its gripping surface; a retainer movable generally toward and away from the first pad between retaining and release positions and including a retaining pin which projects through the hole in the second pad, when the retainer is in its retaining position, the second pad being in the pocket, when the retainer is in its release position, the second pad being outside of the pocket in the second block so that the second pad can be easily removed and replaced; and a fluid-operated cylinder for urging one of the blocks toward the other block, whereby the strip, when between the pads, may be clamped and held firmly by the pads.

7. A machine according to claim 6 wherein the gripping unit further comprises a spring for urging the retainer to its retaining position.

8. A machine according to claim 7 wherein the retainer element includes an actuating pin which is manually accessible for urging the retaining element to its release position against the bias of the spring.

9. A machine according to claim 6 wherein the gripping unit further has pins which lie generally perpendicular to the gripping surface of the first pad and extend from the first pad into the first block to releasably secure the first pad to the first block.

10. A machine according to claim 9 wherein, when the cylinder is not energized, enough space exists between the first block and the second block to separate the first pad from the first block sufficiently to disengage its pins, so that the first pad can be removed from the first block.

11. A machine according to claim 6 wherein the cylinder is attached to and moves the first block.

12. A machine according to claim 6 wherein the first pad rocks with respect to the cylinder to accommodate uneven surfaces on the strip.

13. A machine for advancing a strip of metal sheet along a path in increments, said machine comprising: a main frame along which the path extends and having at its ends ways which extend transversely with respect to the path; first and second subframes having front and rear brackets at their ends, with the brackets being mounted on the ways for movement along the ways, whereby the subframes may be moved together or apart, the subframes having tracks which lie along the sides of the path, whereby the subframes, when moved together or apart, vary the width of the path; fixed gripping units mounted on the subframes at the front brackets, each fixed gripping unit having pads which are located along opposite faces of the strip when strip is along the path, the fixed gripping units including fluid-operated cylinders for moving the pads together to clamp the strip between them and hold the strip in a fixed position along the path; movable gripping units mounted on the tracks for movement along the tracks, each movable gripping unit likewise including pads which are located along opposite faces of the strip when the strip is along the path and a fluid-operated cylinder for moving the pads together to clamp the strip between them, idler and drive sprockets carried by each subframe; an endless chain extended over the idler and drive sprockets on each subframe and connected to the movable gripping which is on the track of that subframe; a motor on each subframe and connected to the drive sprocket on that subframe for moving the gripping unit along the track on that subframe; the cylinder and motor for the movable gripping unit on the first subframe being operable independently of the cylinder and motor for the gripping unit on the second subframe, whereby the movable gripping units may operate alternately to advance the strip along the path.

14. A machine according to claim 13 wherein on each subframe the motor is mounted at the rear bracket for the subframe; wherein the drive sprocket is mounted on the motor; wherein an idler sprocket is mounted on the front bracket for the subframe; wherein the chain passes over the drive and idler sprockets and is connected at its ends to the gripping unit of that subframe, so as to create an endless configuration, whereby when the motor rotates in one direction, the gripping unit moves along the track toward the front bracket and will advance the strip along the path, and when the motor rotates in the opposite direction, the gripping unit moves away from the front bracket.

15. In a machine for advancing a strip of sheet metal in measured increments, said machine comprising: a frame along which a path extends for accommodating the sheet metal strip, the frame having a front end from which the sheet metal strip is discharged from the machine; a fixed gripping unit supported on the frame and located along the path, the fixed gripping unit having opposed gripping surfaces which are capable of closing upon the strip and clamping it in a fixed position along the path; first and second tracks supported on the frame and located parallel to the path; a first movable gripping unit mounted on the first track for movement along the first track toward and away from the front end; a second movable gripping unit mounted on the second track for movement along the second track toward and away from the front end; a first drive mechanism supported on the frame for moving the first gripping unit on the first track; and a second drive mechanism supported on the frame for moving the second gripping unit on the second track; each drive mechanism including an idler sprocket at one end of the track for the movable gripping unit moved by the drive mechanism, a drive sprocket at the other end of that track, an endless chain extended over the idler and drive sprockets and connected to the gripping unit, and a motor connected to the drive sprocket for rotating the drive sprocket in both directions of rotation, whereby the gripping unit moves along the track, the motor of the first drive mechanism being operable independently of the motor of the second drive mechanism and vice versa so that the first and second movable gripping units may move independently of each other.

16. A machine according to claim 15 wherein the fixed gripping unit is located along a side of the path and at the front end of the frame.

17. A machine according to claim 16 wherein the first and second movable gripping units are located along opposite sides of the path.

18. A machine according to claim 15 wherein each drive mechanism further includes a fluid-operated cylinder which urges, one of the sprockets for that drive mechanism away from the other sprocket for that drive mechanism to maintain the chain for that drive mechanism taut.

19. A machine according to claim 15 wherein the drive sprocket for each drive mechanism is carried by the drive motor for that drive mechanism; and wherein each drive mechanism further includes a fluid-operated cylinder which is supported on the frame and is attached to the motor to urge the motor and the drive sprocket which is on it such that the chain for the drive mechanism remains taut.

20. A machine according to claim 15 further comprising a shear located along the path beyond the discharge front end of the machine frame, the shear being oriented to cut the strip transversely and thereby sever panels from it, with the length of the panels corresponding to the measured incremental advance imparted to the strip by the machine.

* * * * *